United States Patent [19]

Jensen et al.

[11] 4,139,978

[45] Feb. 20, 1979

[54] AUTOMATIC PHOTOGRAPHIC PRINT AND FILM PACKAGING MECHANISM

[75] Inventors: Gerald A. Jensen, Wayzata; Armer J. Willenbring, Bloomington, both of Minn.

[73] Assignee: PAKO Corporation, Minneapolis, Minn.

[21] Appl. No.: 786,182

[22] Filed: Apr. 11, 1977

[51] Int. Cl.[2] ..... B65B 61/28; B65B 5/10

[52] U.S. Cl. ..... 53/167; 53/53; 53/520; 53/564; 53/568; 53/266 A

[58] Field of Search ..... 53/53, 54, 123, 183, 53/187, 244, 259, 266 A

[56] References Cited

U.S. PATENT DOCUMENTS

| | | | |
|---|---|---|---|
| 3,641,733 | 2/1972 | Lerner | 53/183 |
| 3,733,770 | 5/1973 | Erickson et al. | 53/29 |
| 3,789,571 | 2/1974 | Tall et al. | 53/54 |

*Primary Examiner*—Robert Louis Spruill

*Attorney, Agent, or Firm*—Kinney, Lange, Westman and Fairbairn

[57] ABSTRACT

An automatic photographic print and film packaging mechanism inserts individual orders of prints and film into multilayered packaging envelopes formed in a continuous strip. The mechanism sequentially seals the sides of the envelopes and cuts the envelopes from the strip. The mechanism has provision for either sealing the top of a cut envelope and depositing the same in a first collection station or depositing the cut envelope with the top unsealed into second collection station.

14 Claims, 13 Drawing Figures

68
70
62
64
66
26
24
60
20d
20c
58
20b
56
20a
40
36
38a
38b
32
30

AUTOMATIC PHOTOGRAPHIC PRINT AND FILM PACKAGING MECHANISM

BACKGROUND OF THE INVENTION

The least automated portion of the film processing industry traditionally has been the packaging of individual orders of prints and film in envelopes to be returned to the customers. Various mechanisms have been developed to sort prints and film into individual orders. In U.S. Pat. No. 3,733,770 entitled PROCESSOR'S METHOD AND APPARATUS FOR PACKING PHOTOGRAPHS, issued to Arlen J. Erickson and Leonard H. Tall and assigned to CX Processing Laboratories, Inc., a mechanism is shown in which prints and cut film are loaded into collection compartments which are then dumped into a section of a carrier stock strip. The loaded section of carrier stock is subsequently torn along perforations from the strip by chain means. The sections are then hand inserted into a packaging envelope. This method and apparatus is not very efficient as it still requires hand loading of the prints and film into a packaging envelope.

SUMMARY OF THE INVENTION

The present invention provides a totally automatic mechanism for sorting, conveying and packing photographic prints and film into multilayered packaging envelopes formed in a strip, sequentially sealing the sides of the packed envelopes, cutting the envelopes from the strip and then either sealing the mouth of the envelope and ejecting into a first collecting means if it does not contain prints to be remade ("remake" prints), or ejecting the envelope with the top unsealed into a second collecting means if it does contain remake prints.

More specifically, a continuous multilayered packaging strip, including separation lines defining individual envelopes open at the top and sides, is taken from a roll and advanced by intermittant drive means along a transversely inclined conveyor bed. The intermittant drive means stops when the open top, or mouth, of an individual envelope is aligned with the discharge ends of print and film packing means. The discharge ends are positioned in close vertical relation with each other and are positioned in close transverse relation to the upper edge of said conveyor bed. The print and film packing means respectively insert prints and film corresponding to an individual order into adjacent spaces between the layers of an envelope. After the insertion of the prints and film, the intermittant drive means advance the strip one envelope length and simultaneously align the mouth of the last-packed envelope with a stuffing chute and the mouth of the envelope subsequent to the last-packed envelope with the discharge ends. Remake prints associated with the order and other materials are deposited by the chute into a third space between other layers of the envelope.

The packed envelopes of the strip are advanced in one envelope length increments from the stuffing chute toward side sealing means positioned across the conveyor bed and in close relation to the strip. Tensioning means are positioned between the stuffing chute and side sealing means in closely spaced relation to the top edge of the conveyor bed to reestablish and maintain interlayer registration of said separation lines which may have been disturbed by the insertion of prints, film and other materials between the layers.

The side sealing means are positioned so that the separation lines corresponding to a side of an individual envelope are aligned with the sealing means when the drive means are stopped. Side cutting means are positioned transversely to the conveyor bed in close relation to the strip and are positioned one envelope length downstream of the side sealing means. As the side sealing means seal a side of an envelope along the aligned separation lines, cutting means sever the preceding envelope from the strip. This severed envelope is then advanced into top sealing and ejecting means. If the envelope does not contain remake prints, the top sealing and ejecting means will seal the top of the envelope. The sealed envelope will then be advanced by the intermittant drive means into second ejecting means which then deposit the envelope into first collecting means. If the envelope does contain remake prints, the top sealing and ejecting means does not seal the top of that envelope, but instead merely deposits that envelope into second collecting means.

The print packing means referred to in this application for sorting, conveying and packing the prints of individual orders into envelopes can be any mechanism such as the mechanism which is the subject of a co-pending application for U.S. Letters Patent entitled AUTOMATIC PRINT SORTING, CONVEYING AND PACKING MECHANISM Ser. No. 786,184, filed Apr. 11, 1977 and assigned to the instant assignee. The film packing means for conveying and packing the film into the envelopes referred to in this application can be any mechanism such as the mechanism which is the subject of a co-pending application for U.S. Letters Patent entitled AUTOMATIC FILM CONVEYING AND PACKING MECHANISM Ser. No. 786,183, filed Apr. 11, 1977 and is also assigned to the instant assignee.

BRIEF DESCRIPTION OF THE DRAWINGS

FIGS. 1 and 2 together show a top plan view of a portion of the mechanism.

FIGS. 6*a* and 6*b* are side and front views of the side sealing apparatus.

FIGS. 10 and 11 are side elevational views of the top sealing and ejecting mechanism.

DETAILED DESCRIPTION OF THE PREFERRED EMBODIMENTS

Figure 2:
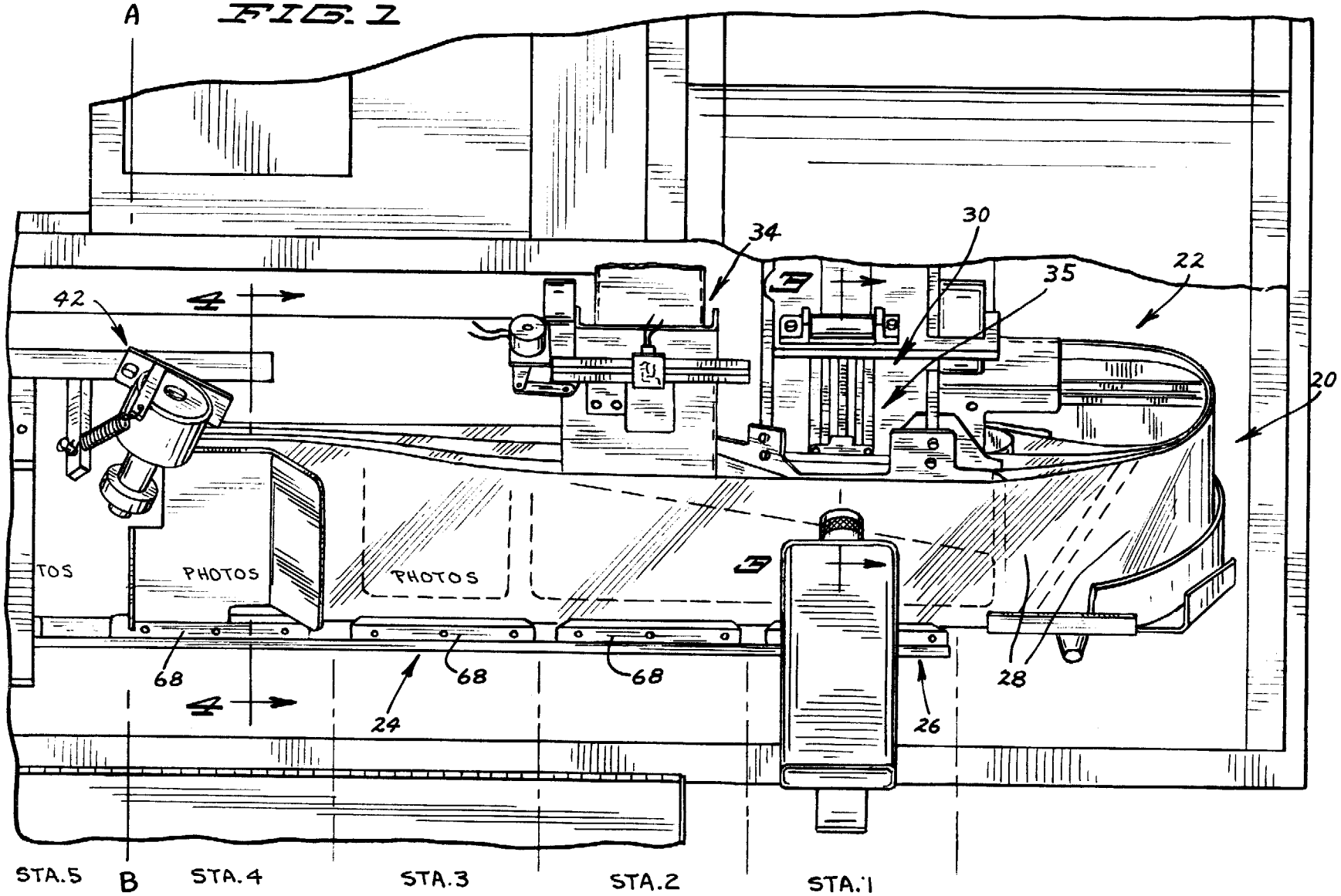

FIGS. 1 and 2 show the automatic photographic print and film packaging mechanism of the present invention. In FIG. 1, a continuous multilayered packaging strip 20 is taken from a roll 22 and transported along a transversely inclined conveyor bed 24 by intermittant drive means 26 positioned in close relation to the bottom edge of said bed 24. Drive means 26 advance strip 20 one envelope length each time drive means 26 are energized. Strip 20 includes transverse separation lines 21 which define individual envelopes 28 open at the top and sides.

Print and film packing means such as print packer 30 and film packer 32 are positioned in close vertical relation to each other (with film packer 32 mounted on or above print packer 30) and are positioned in close transverse relation to the upper edge of bed 24. Insertion of prints and film into envelopes 28, therefore, occurs at the same station or location (designated STA. 1). In the preferred embodiments of the present invention, print packer 30 is the mechanism shown in the previously mentioned patent application entitled AUTOMATIC PRINT SORTING, CONVEYING AND PACKING MECHANISM and film packer 32 is the mechanism shown in the previously mentioned patent application entitled AUTOMATIC FILM CONVEYING AND PACKING MECHANISM.

A stuffing chute 34 is positioned in close transverse relation to the upper edge of bed 24 at STA. 2, which is adjacent to STA. 1. When an envelope 28 is in aligned relation with print packer 30 and film packer 32 at STA. 1, the preceding envelope 28 is in aligned relation with chute 34 at STA. 2.

A plurality of separation plates 36, 38 and 40 (shown in greater detail in FIG. 3) are associated with print and film packers 30 and 32 and stuffing chute 34 to separate the individual layers of strip 20 and pass the layers around the discharge ends of packers 30 and 32 and chute 34. Envelope 28 of strip 20 is in aligned relation with the discharge ends of the packers 30 and 32 to receive the prints and film associated with an individual customer order between different layers of strip 20. Intermittant drive means 26 then advances strip 20 one envelope length and positions envelope 28 in aligned relation with the discharge end of chute 34 to receive various stuffing materials, including prints which must be remade (remake prints), between two other layers of strip 20.

As strip 20 is thus advanced in one envelope length increments beyond stuffing chute 34, tensioning means 42 maintains correct interlayer registration of the separation lines 21 and of the top, open edges of strip 20.

As shown in FIG. 2, a side sealer 44 is positioned transversely upon bed 24 and in close relation with strip 20 and is also positioned an integer number of envelope lengths downstream of stuffing chute 34. Intermittant drive means 26 position the separation lines 21 corresponding to one side of an envelope in correct alignment with side sealer 44 to be heat sealed together, thus leaving the envelope with only the top unsealed. Intermittant drive means 26 advance the last-sealed side into cutting alignment with envelope cutter 46, which is positioned in close transverse relation to bed 24. The distance between side sealer 44 and cutter 46 is equal to the length of an envelope 28. Cutter 46 then severs the envelope from strip 20 by cutting along the side seal, which is wide enough to insure that the edges of the cut will still be sealed.

The severed envelopes 28 are then advanced one envelope length into aligned relation with a top sealing and ejecting mechanism 48. If the envelopes contain no remake prints, mechanism 48 heat seals the top edges of the envelope together. Intermittant drive means 26 then advance the totally sealed envelope 28 one envelope length into an ejecting mechanism 50 which lifts the envelope from intermittant drive means 26 and deposits the same into a holding bin 52. If however, remake prints are contained in the envelope 28, mechanism 48 does not seal the top of the envelope, but instead lifts the envelope from intermittant drive means 26 and deposits it into a holding bin 54 for further processing.

Figure 3:
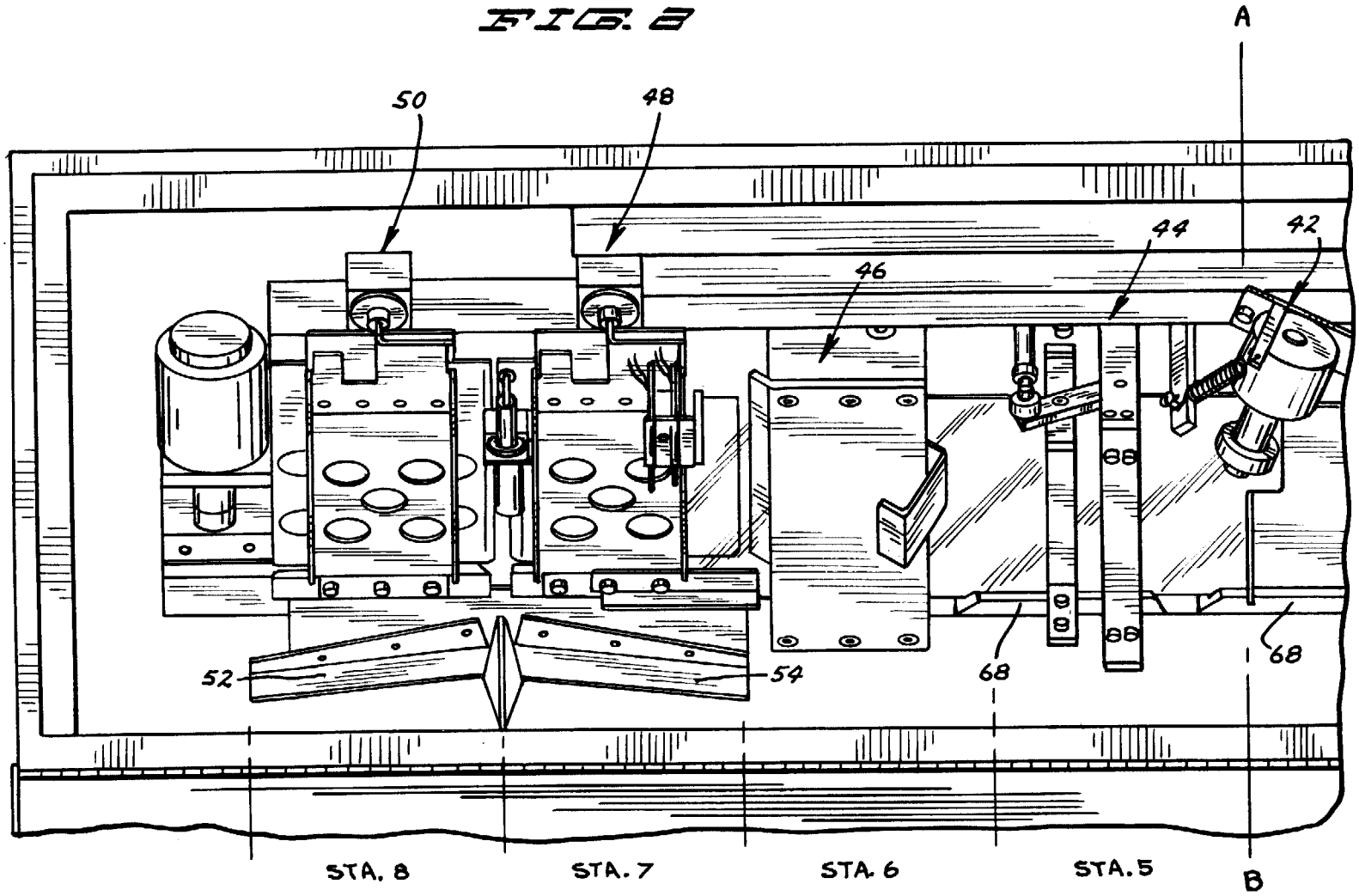
FIG. 3 shows the envelope, film packer and print packer as viewed along line 3—3 of FIG. 1.

In FIG. 3, separation plates 36, 38 and 40 are shown maintaining separation between the four layers **20*a* through 20*d* of strip 20 so that the layers may pass around the discharge ends of the print and film packers 30 and 32. Print mechanism 30 inserts a stack of prints corresponding to an individual customer order between the first and second layers 20*a* and 20*b* of an envelope 28 while film mechanism 32 inserts the stack of film corresponding to the order between the second and third layers 20*b* and 20*c*. Separation plate 36 separates layers 20*a* and 20*b*. Layers 20*b* and 20*c* are separated by separation plate 38, which has an upper portion 38*a* and a lower portion 38*b***.

After the stacks of prints and film are inserted, intermittant drive means 26 advances strip 20 one envelope length to align the envelope 28 with the discharge end of stuffing chute 34. Plate 40 separates the third and fourth layers **20*c* and 20*d* to allow stuffing material and remake prints to be passed through chute 34 and inserted between third and fourth layers 20*c* and 20*d*. The print packer 30 and film packer 32** are the subject matter of the two previously mentioned co-pending applications assigned to the assignee of the present application and are treated in more detail therein.

Figures 3, 4:
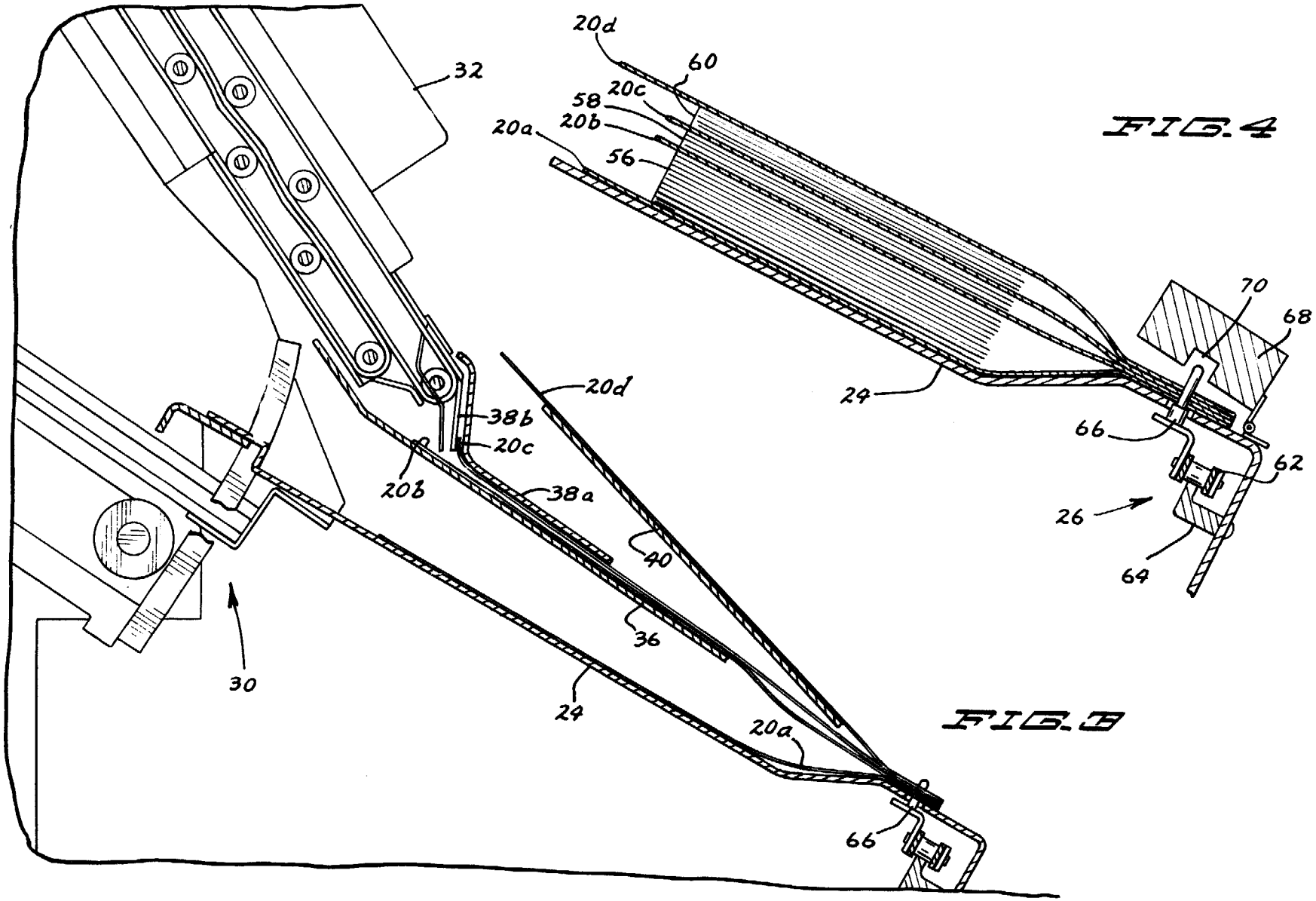
FIG. 4 is a sectional view of the conveyor bed, intermittant drive means and envelope taken substantially along the line 4—4 of FIG. 1.
Figure 5B:
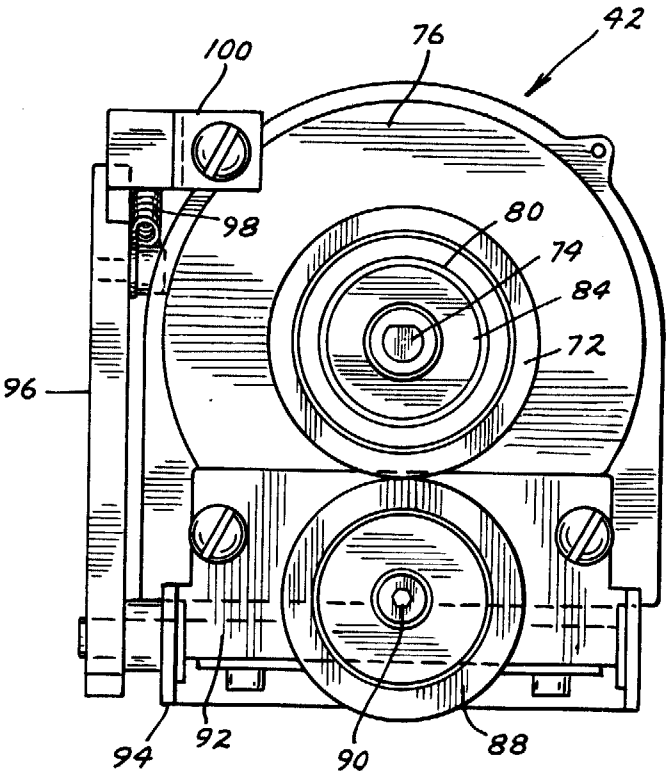
FIGS. 5*a* and 5*b* are side and front views of the tensioning means.
Figure 5A:
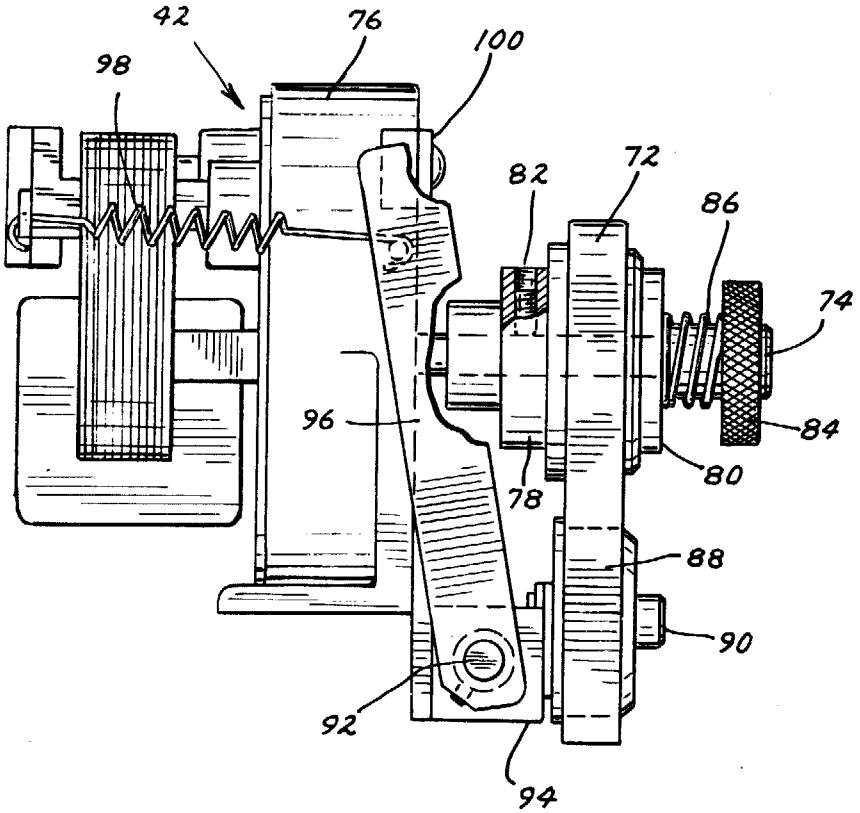
Figure 5A:
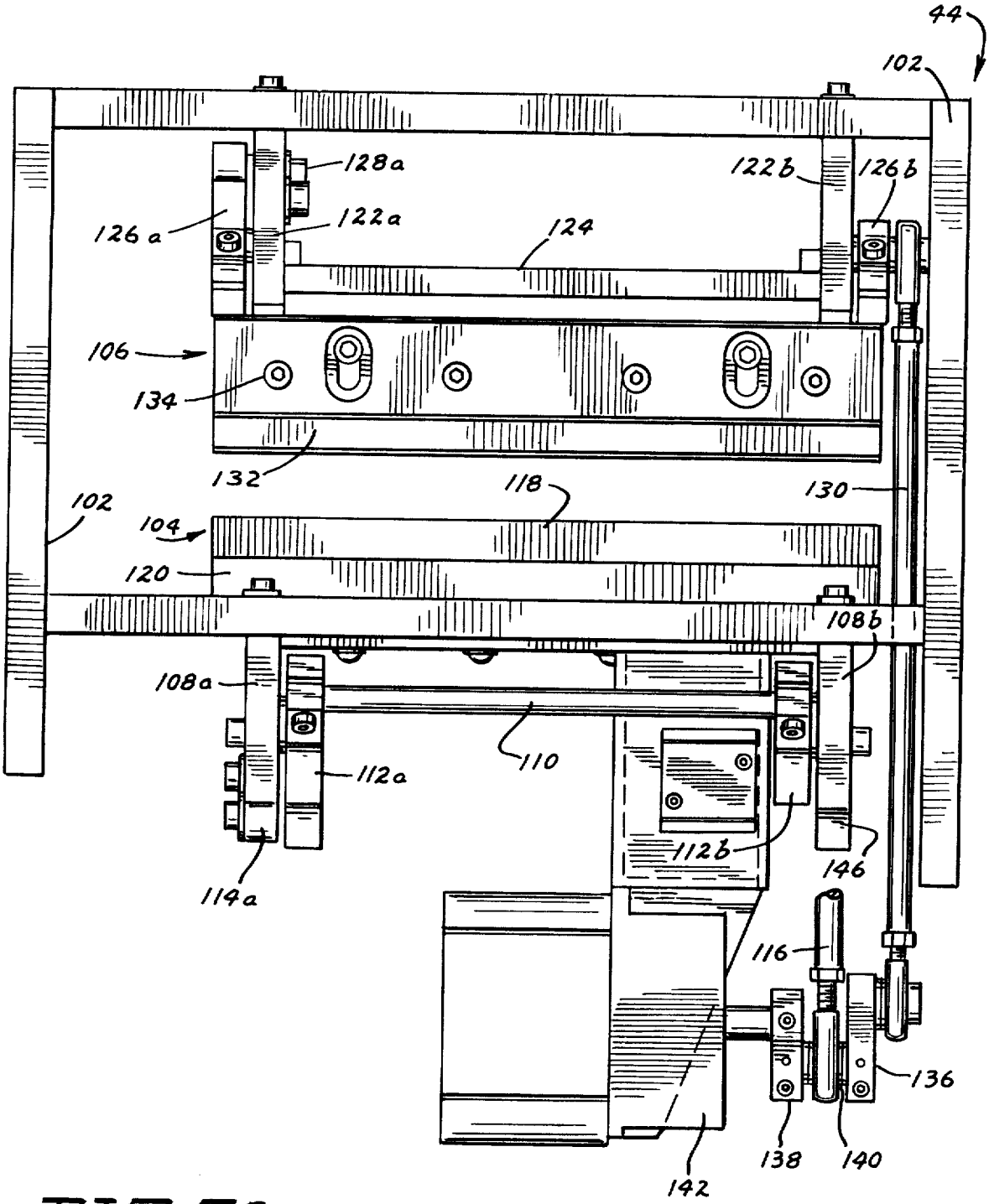

FIG. 4 shows an envelope at STA. 4, which is downstream from STA. 1 and STA. 2. The envelope contains a stack of prints 56 between layers **20*a* and 20*b*, a stock of film 58 between layers 20*b* and 20*c*, and a stack of remake prints or other stuffing materials 60 between layers 20*c* and 20*d***.

As shown in FIG. 4, conveyor bed 24 has a longitudinal bend with a shallow taper closely disposed toward the bottom edge thereof. Intermittant drive means 26 comprise an endless chain 42 positioned in close relation to the bottom edge of bed 24 and extending substantially the entire length of bed 24 supported by a plurality of rollers such as roller 64. Chain 63 may be driven, for example, by a sprocket and motor arrangement (not shown). A plurality of teeth 66 are attached in uniform spaced relation to chain 62 and extend upwardly and through a longitudinally-entending opening formed in bed 24 as shown. Layers **20*a*, 20*b*, 20*c*, and 20*d* of strip 20 are layers of flexible material joined together at their bottom ends. The bottom ends have a plurality of uniformly spaced holes therein registering with teeth 66 to provide driving interconnection between strip 20 and chain 62. A plurality of envelope positioning blocks 68 are resiliently hinged to the bottom end of bed 24 and are positioned above chain 62 in close relation thereto. Blocks 68 have grooves 70 formed in the bottom thereof to allow teeth 66 to be transported therethrough and thus prevent strip 20 from being overdriven by teeth 66**.

FIGS. **5*a* and 5*b* show tensioning means 42, which includes a drive roller 72 constructed of a high friction material rotatably mounted on shaft 74 of motor 76 between washers 78 and 80. Washer 78 is more closely disposed toward motor 76 than roller 72 and is attached to shaft 74 by a set screw 82. Knob 84 threaded onto shaft 74 varies the pressure exerted by spring 86 on washer 80 and roller 72. Idler roller 88 is positioned in normally closely spaced coplanar relation with roller 72 and is rotatably mounted on a shaft 90 which is attached to a roller tensioning element 92. Supports 94 are worked on the lower portion of motor 76 and are journaled to receive the ends of tensioning element 92. One end of element 92 entends through a support 94 and is attached to one end of a positioning bar 96. The other end of bar 96 is connected by a spring 98 to an upper rear corner of motor 76. A bar stop 100 is provided in the upper front corner adjacent to said upper rear corner to limit the travel of bar 96. Strip 20 is advanced between rollers 72 and 88 by intermittent drive means 26**.

Figure 6B:
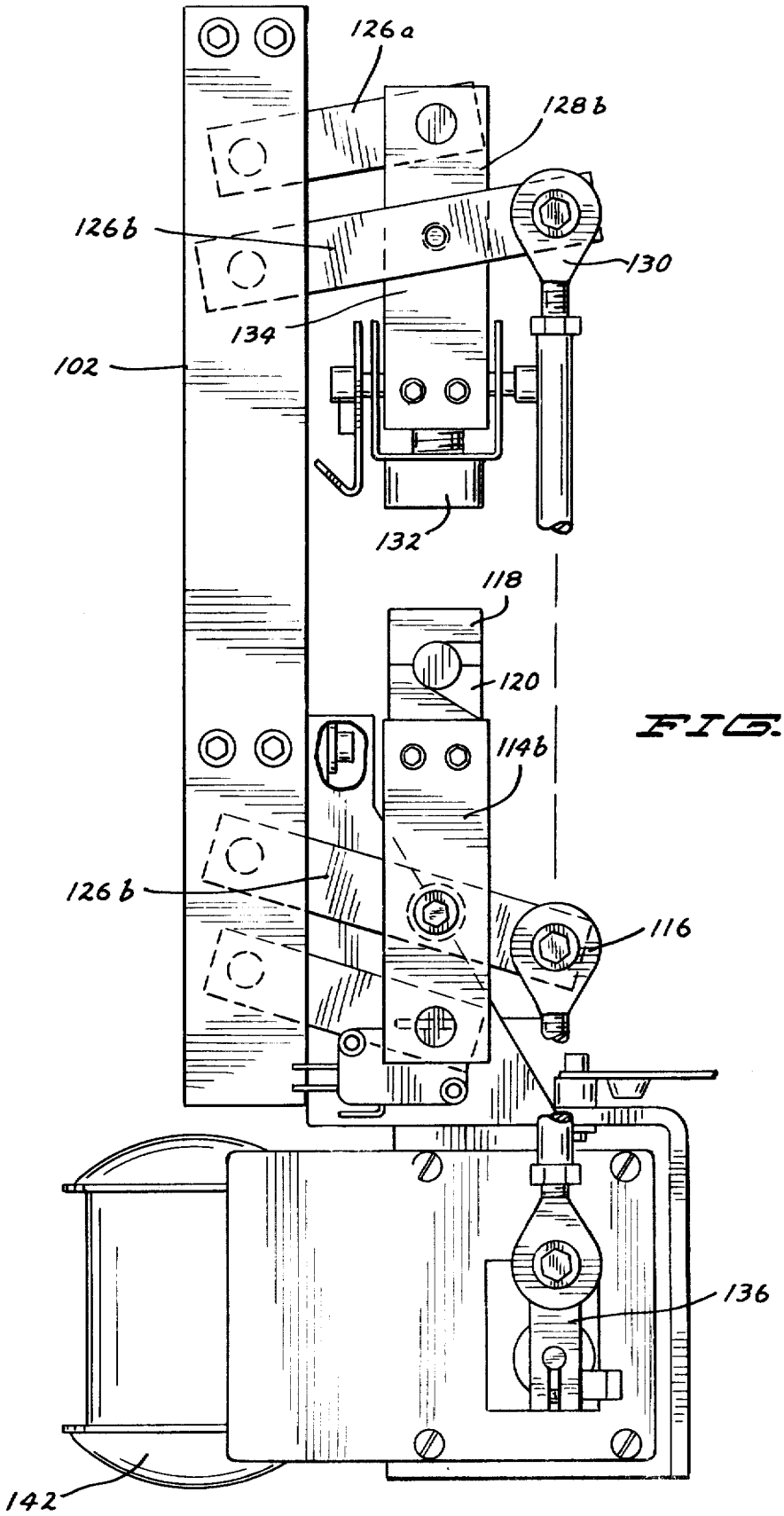

In FIGS. 6*a* and 6*b*, side sealer 44 is shown in more detail. A rigid rectangular frame 102 supports lower and upper side sealing assemblies 104 and 106 in normally spaced apart vertical relation. Lower assembly 104 is supported by a pair of lower support arms 108*a* and 108*b* depending from frame 102 and which are journaled to receive the ends of lower support rod 110. One end of each of lower assembly pivot arms 112*a* and 112*b* are attached to support rod 110 and are closely disposed toward support arms 108*a* and 108*b* respectively. Pivot arm 112*a* is rotatably connected at its other end to an arm 114*a*. Pivot arm 112*b* is rotatably connected at an intermediate point to arm 114*b* and the other end of pivot arm 112*b* is rotatably connected to one end of link 116. Heating element or platen 118 is attached to the top of cross member 120.

Upper assembly 106 is supported by a pair of upper support arms 122*a* and 122*b* depending from frame 102 and which are journaled to accept the ends of upper support rod 124. One end each of upper pivot arms 126*a* and 126*b* are attached to support rod 124 and closely disposed towards support arms 122*a* and 122*b* in the manner shown. Pivot arm 126*a* is rotatably connected at its other end to an arm 128*a*. Pivot arm 126*b* is rotatably connected at an intermediate point to arm 128*b* and the other end of arm 126*b* is rotatably connected to the upper end of link 130. Pressing bar 132, which is preferably a silicone rubber sponge, is attached to the bottom of cross member 134.

The other lower end of link 130 is rotatably mounted to one end of link arm 136. The other end of link arm 136 is attached to an end of link arm 138 by cross member 140, with arms 136 and 138 positioned in aligned relation to each other. The other end of link 116 is rotatably mounted on cross member 140. The other end of link arm 138 is connected to motor 142 as shown.

The side sealer 44 shown in FIGS. 6*a* and 6*b* has several advantages. First, it is simple and compact. Second, it utilizes symmetrical motion. Third, it is easily adjustable to allow increase dwell times. Fourth, it supplies heat from the back (paper) side of strip 20 rather than the top side. In preferred embodiments the top layer of strip 20 is a plastic material. Heating from the back side, as is done with the side sealer 44 of FIGS. 6*a* and 6*b* greatly relaxes the temperature control required and generally results in superior seals.

Figure 7:
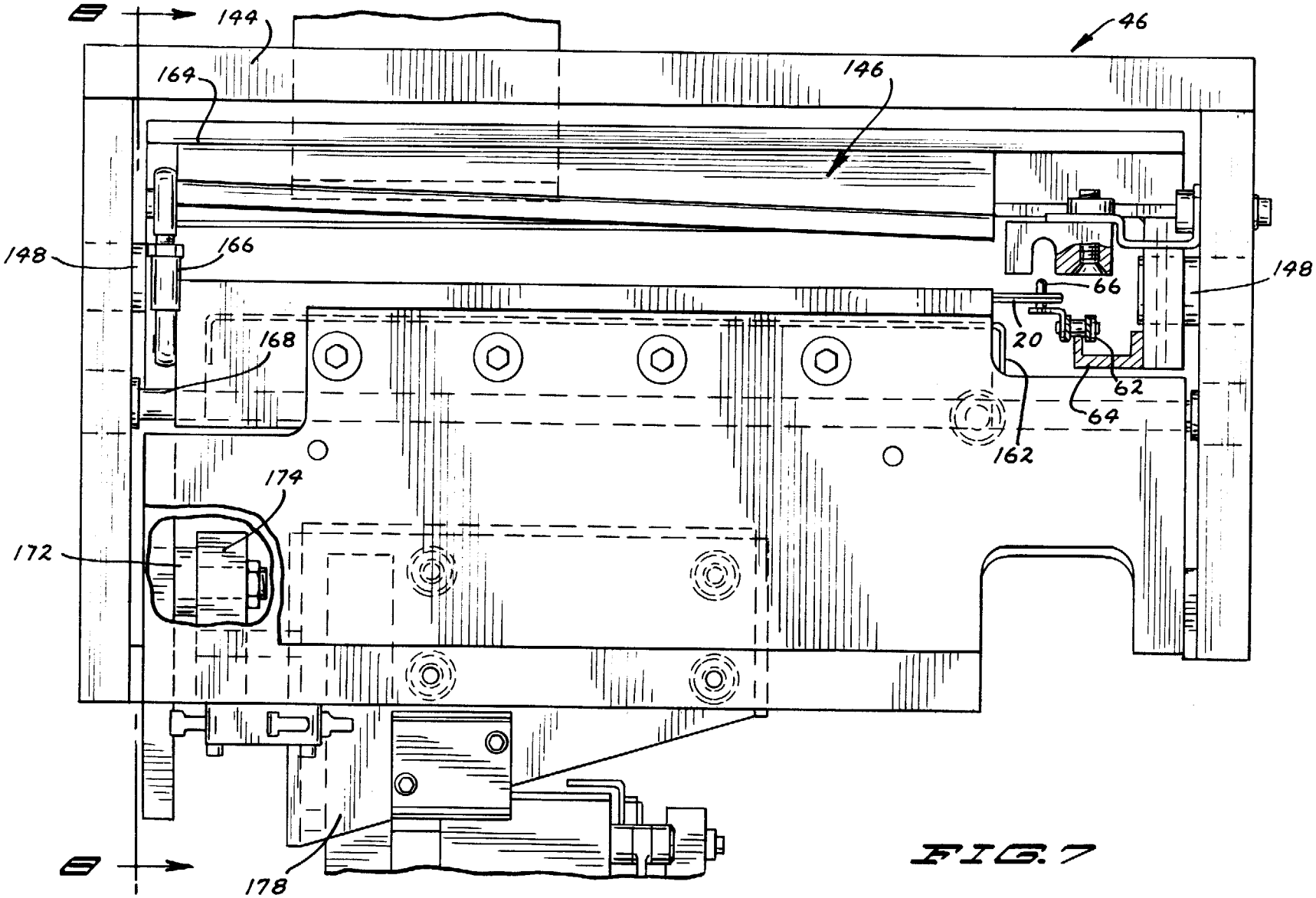
FIG. 7 is a side elevational view of the side cutting apparatus.
Figure 8:
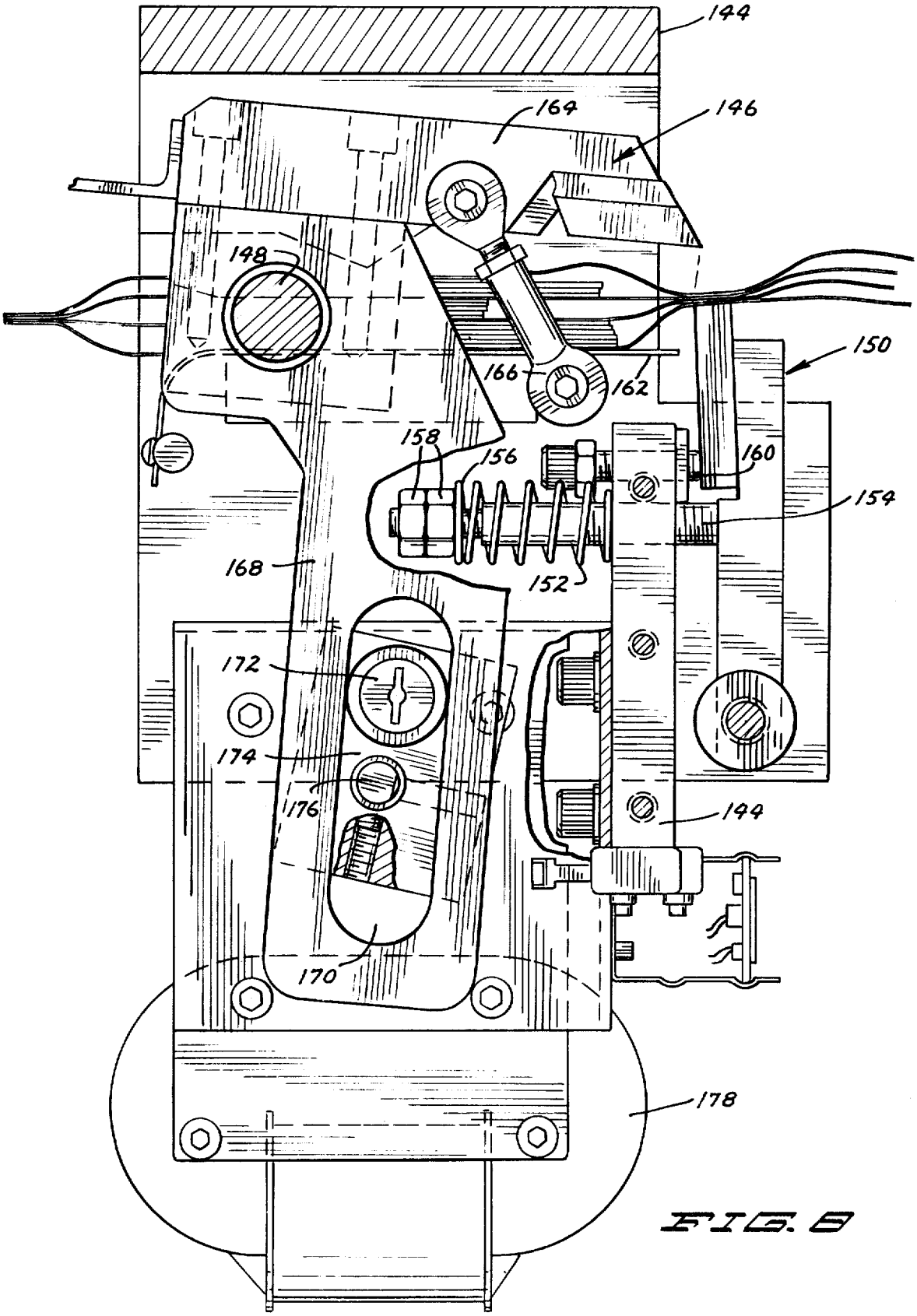
FIG. 8 is a sectional view of the side cutting mechanism taken substantially along the lines 8—8 shown in FIG. 7.

As shown in FIGS. 7 and 8, envelope cutter 46 includes a generally rectangular support frame 144 to which upper cutting blade assembly 146 is pivotally connected by a pair of pins 148. Lower cutting blade assembly 150 is privotally connected to frame 144 and is resiliently positioned in close relation to the front section of frame 144. A plurality of springs 152 are kept on pins 154 by washers 156 and nuts 158 threaded onto the ends of pins 154. A stop 160 is provided to prevent lower cutting blade assembly 150 from coming into contact with the front section of frame 144.

The lower end of a generally curved envelope support plate 162 is pivotally attached to frame 144 and is positioned in normally close perpendicular relation to the upper portion of lower cutting blade assembly 150. Plate 162 is connected at an intermediate point to the upper arm 164 of upper cutting blade assembly 146 by link 166. The lower arm 168 of blade assembly 146 has a cam slot 170 in which is positioned a pin 172 of cam block 174. Cam block 174 is connected to a shaft 176 which is in turn connected to motor 178. Packaging envelope strip 20 is transported through cutter 46 as shown by chain 62 and is supported by support plate 162 while passing through.

The envelope cutter assembly shown in FIGS. 7 and 8 has several important advantages. First, it is extremely simple, with only four moving parts. Second, it provides the needed clearance so that envelopes containing a stack of as many as forty curled prints can pass without interference from the cutter assembly. Third, it is capable of cutting films such as polyethylene.

Figure 9:
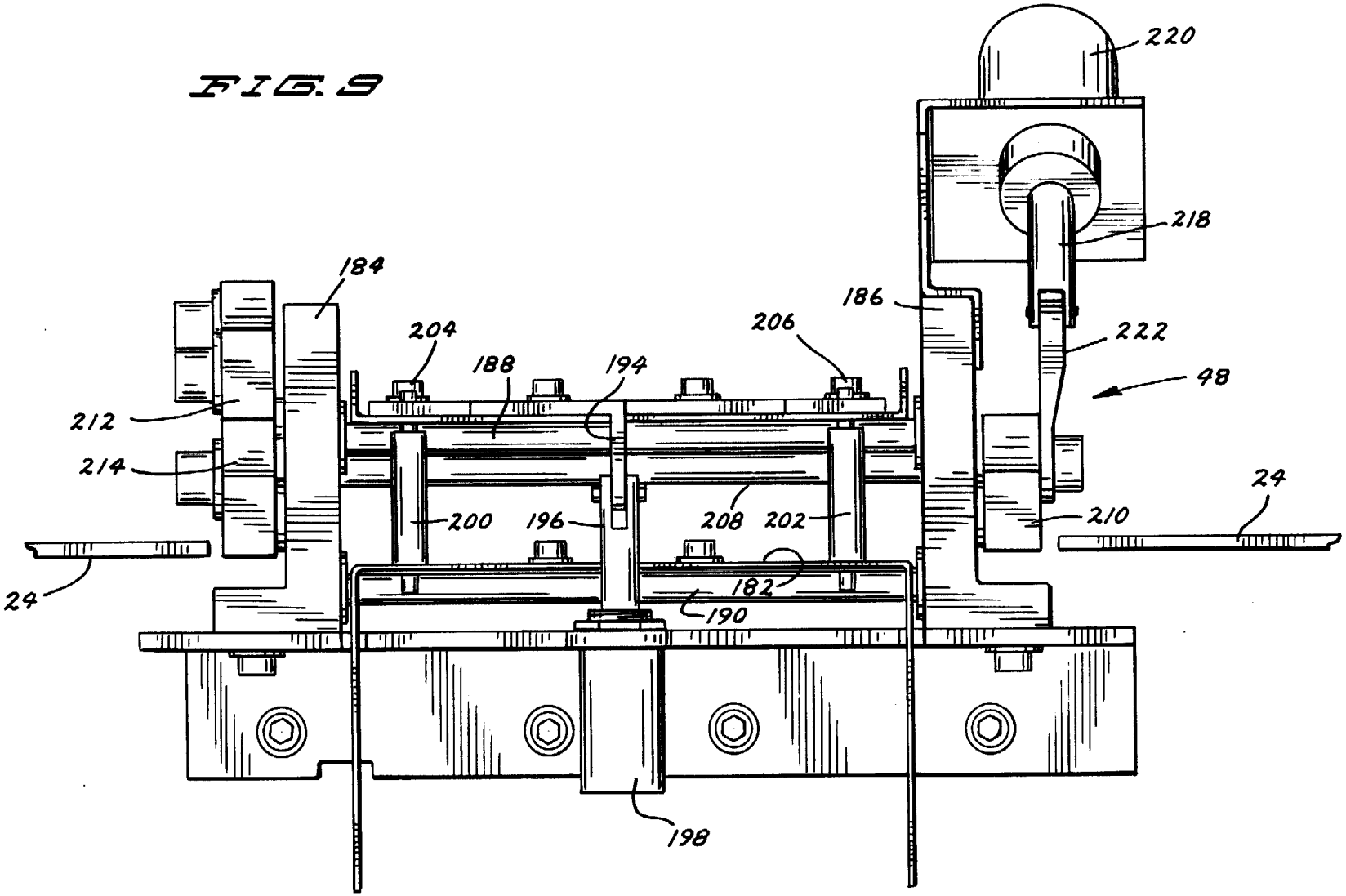
FIG. 9 is a back elevational view of the top sealing and ejecting mechanism.
Figure 10:
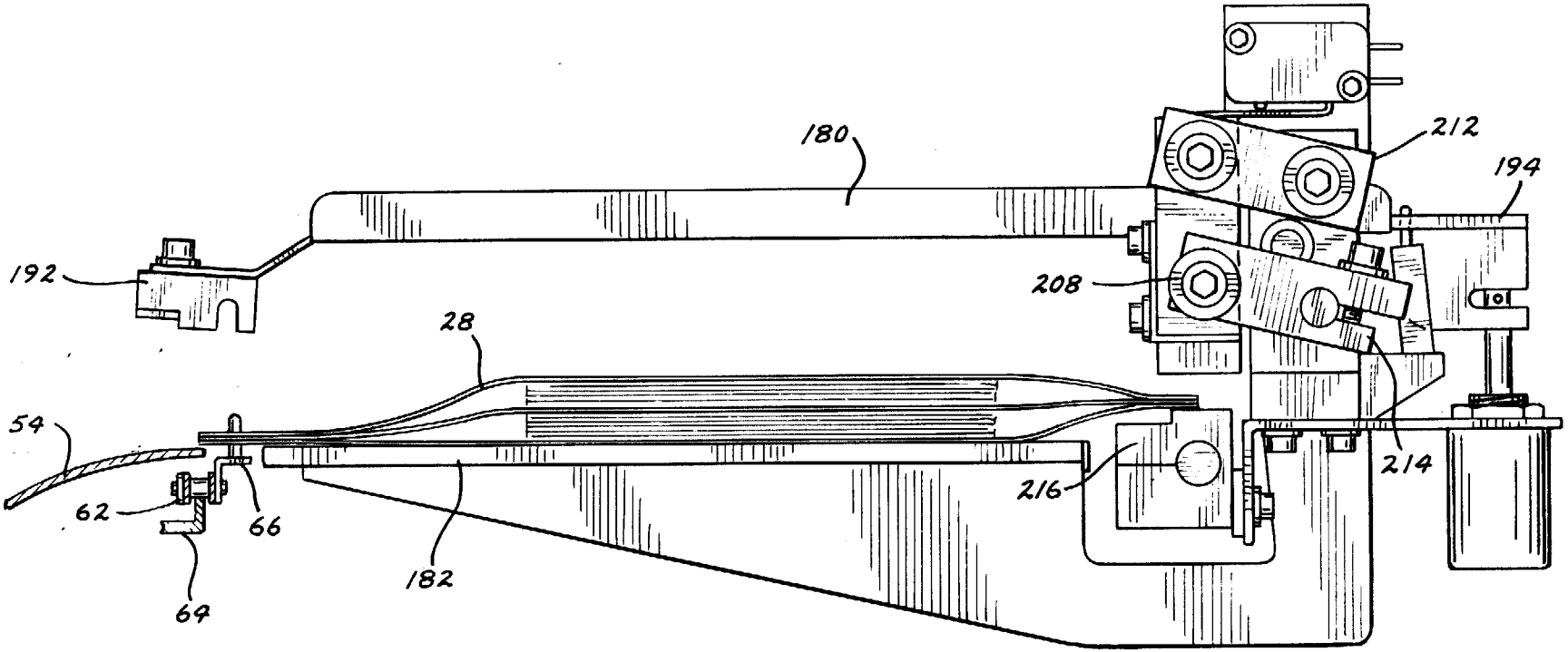
Figure 22:
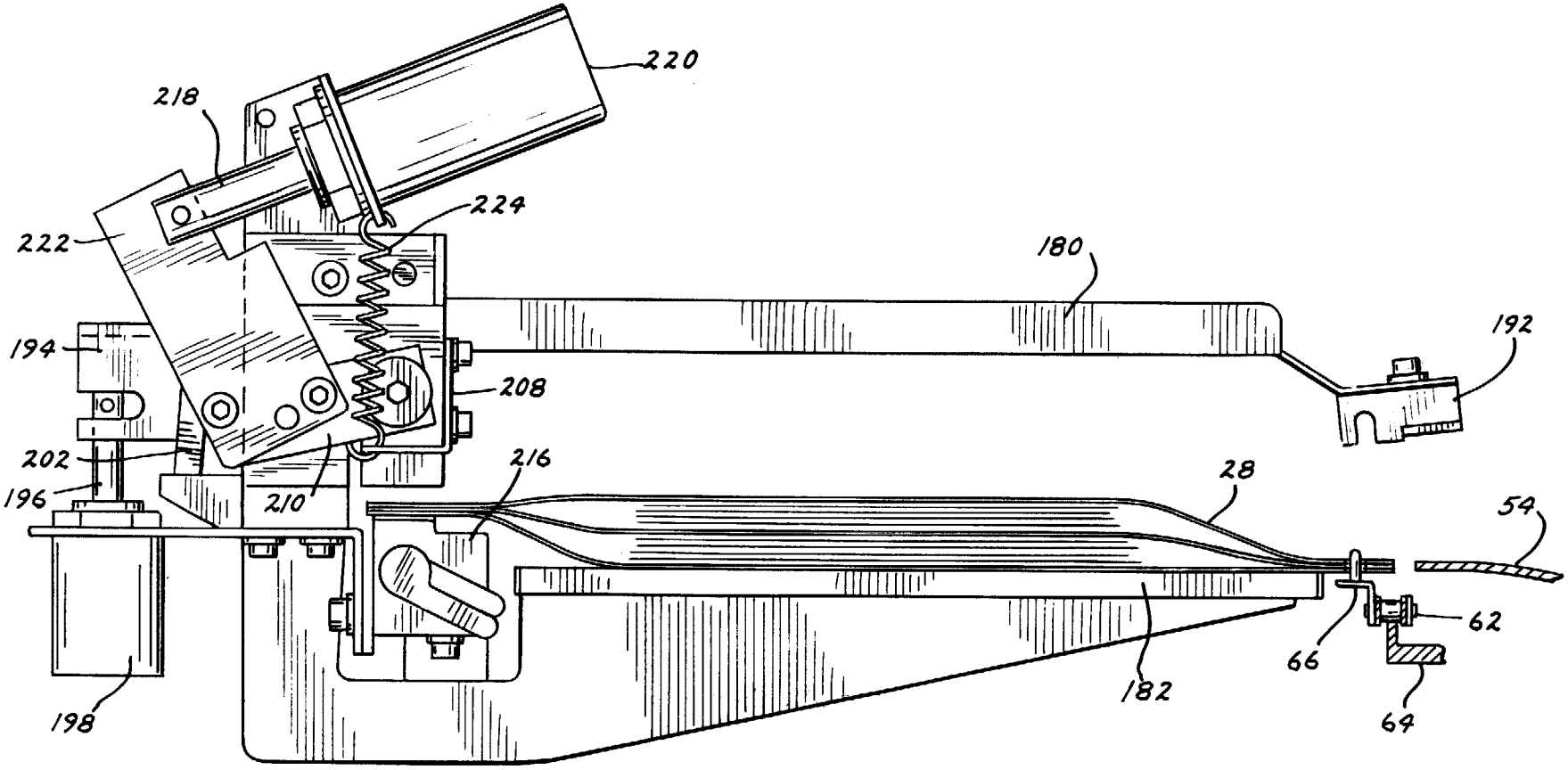

FIGS. 9–11 show top sealing and ejecting mechanism 48, which includes top and bottom plates 180 and 182 pivotally connected at one end to a pair of supports 184 and 186 by rods 188 and 190. In FIG. 11, top plate 180 is shown substantially pivoted upwardly and has an envelope guide 192 mounted at the end remote from rod 188, guide 192 being grooved to permit the teeth 66 of chain 62 to pass therethrough. An arm 194 depends from top plate 180 and is notched to accept lever element 196 of solenoid 198. Sleeves 200 and 202 are positioned in substantially vertical relation between the pivoted ends of top and bottom plates 180 and 182 and are maintained in such position by pins 204 and 206 which are slidably connected between said plates 180 and 182. The length of sleeves 200 and 202 is such that the upper ends of the sleeves do not come in contact with upper plate 180 when it is not being pivoted upwardly, as best shown in FIG. 9.

A top sealing bar 208 is positioned spaced apart parallel relation to supports 184 and 186 and is pivotally connected thereto by pivot arms 210, 212, and 214. A sealing element 216 is connected to supports 184 and 186 and is positioned under sealing bar 208 in spaced aligned relation thereto. As shown in FIG. 11, solenoid lever element 218 of solenoid 220 is movably connected to member 222 which is in turn attached to pivot arm 210. A spring 224 is connected between solenoid 220 and top sealing bar 208. The width of mechanism 48, measured between the outside edges of pivot arms 210 and 214 is approximately the same as the width of an individual envelope. Ejecting mechanism 50 (FIG. 2) is constructed in an identical fashion as mechanism 48, except that mechanism 50 does not include solenoid 220, member 222, top sealing bar 208, sealing element 216 or pivot arms 210, 212, and 214.

In typical operation, chain 62 removes strip 20 from the roll 22 and advances it toward print and film packers 30 and 32. Separation plates 36, 38 and 40 separate the layers of strip 20 and allow the layers to pass around the discharge ends of said mechanisms 30 and 32. Drive means 26 are denergized when an individual envelope 28 is aligned with the discharge ends and prints and film corresponding to an individual order are then deposited between the layers as shown. Chain 62 then advances strip 20 one envelope length so that the last-filled envelope 28 is now in alignment with stuffing chute 34. Stuffing materials and remake prints may then be deposited by chute 34 between two other layers of strip 20 as shown simultaneously with the depositing of film and prints into the following envelope 28. Intermittent drive means 26 then increments strip 20 by one envelope length to bring other envelope 28 into alignment with packers 30 and 32 and chute 34. The shallow longitudinal bend in bed 24 absorbs the energy in the moving pack of prints being inserted to ensure that the prints stay in a stack in the center of the envelope.

As strip 20 is being advanced from stuffing chute 34 and toward sealer 44, it passes between rollers 72 and 88 of tensioning means 42. The registration of perforation lines 21 of the two outer sheets of strip 20 may be disturbed when the prints and film are inserted into strip 20, and must be reestablished to assure that the envelopes 28 are properly sealed and cut by sealer 44 and cutter 46 respectively and that the envelopes 28 look neat and open with ease. Tensioning means 42 achieves this purpose by gently pulling upward on the outer two sheets of strip 20. Idler roller 88 may be privoted downwardly and away from drive roller 72 so that strip 20 may be easily positioned therebetween. Tension spring 98 insures that roller 88 will maintain contact between strip 20 and roller 72 and controls the upward forward force applied to the layers of strip 20. Motor 76 is energized only when intermittent drive means 26 are energized, and rotates faster than strip 20 is transported by drive means 26. The force of roller 72 on strip 20 is varied by compression spring 86 and knob 84 which control the amount of slippage of roller 72 against washer 78. The force of roller 72 against strip 20 can be increased until the frictional force exerted by strip 20 against roller 72 is overcome by the frictional drive force exerted on roller 72 by washer 78 and roller 72 starts slipping against strip 20. The force thus exerted on strip 20 realigns the layers of strip 20 so that the perforation lines 21 are again in proper registration so that side sealer 44 may properly seal the envelopes. In other words, the operation of tensioning means 42 is controlled by two springs: tension spring 98 and compression spring 86. Tension spring 98 controls the upward force on the sheets, and compression spring controls the forward force on the sheets to make the envelopes 28 symmetrical.

Chain 62 advances strip 20 through side sealer 44 until the separation lines 21 corresponding to one side of an envelope 28 are positioned directly between heating element 118 and pressing bar 132. Then motor 142 is energized and rotates cross-member 140 upwardly, forcing link 116 upwardly and link 130 downwardly. This in turn caused the assemblies 104 and 106 to move towards each other and contact the strip along the separation lines 21. Heating element 118 heat seals the layers of envelope strip 20 together, while pressing bar 132 provides the necessary support to said strip 20. Motor 142 then rotates crossmember 140 back into its original position, separating assemblies 104 and 106. Chain 62 then advances the sealed separation lines 21 into position to be cut by cutter 46. Cutter 46 and side sealer 44 are positioned approximately one envelope width apart, so that as side sealer 44 is sealing a side of an envelope 28 along the corresponding separation lines 21, cutter 46 simultaneously is cutting along the last sealed separation lines 21.

As shown in FIGS. 7 and 8, motor 178 of cutter 46 rotates cam block 174 counterclockwise, thus pivoting upper assembly 146 downwardly toward lower assembly 150. As upper assembly 146 pivots downwardly, link 166 forces support plate 162 downwardly to cause the sealed separation lines 21 to make good contact with lower assembly 150. The blade of upper assembly 146 "wipes" against the blade of the lower assembly 150, moving it slightly outward against the pressure of springs 152 to ensure a clean cut. The blade of upper assembly 146 is positioned in a diagonal manner to assembly 150 to facilitate clean cutting of envelope 28 from strip 20. Upper assembly 146 is then returned to its normal position and the envelope strip 20 is transported through cutter 46 by drive means 26 until another sealed separation line 21 is positioned between assemblies 146 and 150. The width of the seal along lines 21 is wide enough so that the edges of the cut made by cutter 46 are sealed together as well.

The cut individual envelope 28 is then transported by intermittent drive means 26 into alignment with top sealing and ejecting mechanism 48. If the envelope 28 contains all good prints, solenoid 220 is energized and pivots top sealing bar 208 downwardly and forces the open mouth of envelope 28 into contact with sealing element 216 which then heat seals the mouth. Solenoid 220 is then denergized and bar 208 is returned to its original position by spring 224. If, however, remake prints were inserted into envelope 28 by stuffing chute 34, solenoid 220 is not energized, but means (not shown) actuate solenoid 198 which pivots top plate 180 upwardly and away from chain 62 until plate 180 contacts the top edges of sleeves 200 and 202. Sleeves 200 and 202 then force lower plate 182 to pivot upwardly with plate 180, the plate 182 lifting envelope 28 upwardly and out of driving interconnection with the teeth of chain 62. Top plate 180 is pivoted slightly upward before lower plate 182 is engaged by sleeves 200 and 202 to prevent envelope 28 from hanging up on envelope guide 192. Guide 192 performs the same envelope positioning function as the blocks 68 shown in FIG. 4. Since conveyor bed 24 is inclined, envelope 28 slides off lower plate 182 and into a holding bin 54 for further print processing. The mouth of envelope 28 is not sealed to provide easy access to the prints contained therein. Solenoid 198 is then denergized and plates 180 and 182 return to their original positions to receive the next envelope. Top-sealed envelopes 28 are not ejected into bin 54, but are advanced by drive means 26 into alignment with ejecting mechanism 50, which then lifts envelope 28 from chain 62 in the same way as mechanism 48 does and deposits it in bin 52. The envelopes 28 in bin 52 are ready to be priced and distributed to the individual customers.

It will be seen that we have provided a highly efficient and automatic sealing, cutting and ejecting mechanism for packing film and prints into individual envelopes contained in a continuous multilayer strip.

It will, of course, be understood that various changes may be made in the form, details, arrangement and proportion of the parts without departing from the scope of the invention, which generally stated, consists in the matter set forth in the accompanying claims.

What is claimed is:

1. An automatic photographic print and film packing apparatus for packaging individual customer orders of prints and film for subsequent distribution, the apparatus comprising:

means supplying a continuous multilayered packaging strip having its layers joined together along only one edge thereof to permit separation of the unconnected layers portioned and including transverse separation lines defining individual packaging envelopes open at the top and sides to package said individual orders therein;

a conveyor bed extending substantially the entire length of the apparatus to support the strip during the packaging of the orders;

intermittent drive means for advancing the strip along the conveyor bed;

means for separating the layers of said multilayered strip to provide open topped pockets in each envelope for each order;

print and film packing means positioned in close relation to the open topped pockets of the envelopes to insert an individual order of prints and film corresponding to the individual order between respective layers of each envelope;

envelope side sealing positioned downstream of the print and film packing means for sealing the sides of the envelopes along the transverse separation lines;

envelope side cutting means positioned downstream of the envelope side sealing means for cutting the sides of the envelopes along the transverse separation lines;

envelope top sealing means positioned in close transverse relation to the conveyor bed downstream of the envelope side sealing and cutting means for sealing the tops of only those envelopes containing completed orders;

first ejecting means for ejecting envelopes having sealed tops at a first collection station; and second ejecting means for ejecting the envelopes having unsealed tops at a second collection station.

2. The apparatus set forth in claim 1 wherein the conveyor bed has a longitudinal upwardly directed bend closely disposed toward its lower edge to absorb the energy in the prints being inserted to ensure that they stay in a stack in the center of the envelope.

3. The apparatus set forth in claim 1 and further comprising stuffing means positioned in close relation to the open tops of the envelopes and between the print and film packing means and the envelope side sealing and cutting means to insert prints to be remade and other materials between the layers of the envelopes.

4. The apparatus set forth in claim 1 and further comprising tensioning means positioned in close relation to the strip and between the print and film packing means and the envelope side sealing means to provide correct interlayer registration of the transverse separation lines after insertion of the film and prints for proper side sealing of the envelopes.

5. The apparatus set forth in claim 4 wherein the tensioning means comprises:

a high friction drive roller and an idler roller positioned in contact with opposite sides of the strip to exert tensioning force thereon and provide correct interlayer registration of said separation lines; and driving means attached to the drive roller and adjustable to vary the amount of rotational force transmitted to the drive roller and thus vary the amount of tensioning force exerted upon said strip, the direction of rotation of the drive and idler rollers being actually divergent from the direction of travel of the strip.

6. The apparatus set forth in claim 1 wherein the envelope top sealing and first ejecting means comprises:

top and bottom plates positioned in aligned parallel relation with each other and pivotally attached to the top edge of the conveyor bed, with the strip passing between the plates;

sealing means positioned between the plates and aligned with the open tops of the envelopes to seal the open top of the envelope positioned in sealing relation therewith;

positioning means attached to the top plate to maintain driving engagement of the strip by the intermittent drive means as the strip is advanced between the plates and to correctly position the envelope in sealing relation with the sealing means;

first collection means positioned in close space relation to the bottom plate to receive the top sealed envelopes;

means for pivoting the bottom plate upwardly after the top of the envelope is sealed to lift the envelope from engagement with the intermittent drive means, the envelope then sliding off the bottom plate and into the first collection means; and means for pivoting the top plate upwardly immediately before the bottom plate is pivoted upwardly to prevent the envelope from being jammed between the top and bottom plates by the positioning means.

7. The apparatus set forth in claim 6 and further comprising:

ejecting means positioned in close transverse relation to said conveyor bed and downstream of said top sealing and ejecting means;

second collection means positioned in close relation to the bottom of said ejecting means;

wherein said top sealing and ejecting means does not seal the tops of envelopes containing prints to be remade, but merely ejects the same into said first collection means for further processing; and wherein said intermittent drive means advances the top sealed envelopes into said ejecting means to be deposited by the same into said second collection means.

8. The apparatus of claim 1 wherein the envelope side sealing means comprises:

a heater platen for contacting a layer of the strip closest to the conveyor bed;

an unheated platen for contacting a layer of the strip furthest from the conveyor bed; and a drive assembly for driving the heater platen and the unheated platen together to apply heat and pressure to the strip along the transverse separation lines.

9. The apparatus of claim 8 wherein the unheated platen comprises a spring loaded sponge surface platen.

10. The apparatus of claim 9 wherein the sponge surface platen comprises a silicone rubber.

11. The apparatus of claim 8 wherein the drive assembly comprises:

motor means; and parallelogram linkages connected to the motor means for driving the heater platen and the unheated platen.

12. The apparatus of claim 8 wherein the layer of the strip closest to the conveyor bed is paper and the layer of the strip furthest from the conveyor bed is a plastic material.

13. The apparatus of claim 1 wherein the envelope side cutting means comprises:

an upper knife assembly pivoted about a first pivot point, the upper knife assembly having a first knife edge;

a lower knife assembly pivoted about a second pivot point, the lower knife assembly having a second knife edge at a diagonal with respect to the first knife edge; and upper assembly drive means for pivoting the upper knife assembly toward the lower knife assembly, whereby the first knife edge wipes against the second knife edge and causes the lower knife assembly to pivot about the second pivot point.

14. The apparatus of claim 13 wherein the envelope side cutting means further comprises:

spring means for applying pressure opposing the pivoting of the lower knife assembly about the second pivot point.

* * * * *